US005870108A

United States Patent [19]

Chen et al.

[11] Patent Number: 5,870,108

[45] Date of Patent: Feb. 9, 1999

[54] INFORMATION HANDLING SYSTEM INCLUDING MAPPING OF GRAPHICS DISPLAY DATA TO A VIDEO BUFFER FOR FAST UPDATION OF GRAPHIC PRIMITIVES

[75] Inventors: Inching Chen, Wappingers Falls; Richard Edward Matick, Cortlandt Manor, both of N.Y.

[73] Assignee: International Business Machines Corporation, Armonk, N.Y.

[21] Appl. No.: 951,275

[22] Filed: Oct. 16, 1997

Related U.S. Application Data

[63] Continuation of Ser. No. 370,090, Jan. 9, 1995, abandoned.

[51] Int. Cl.[6] ..... G09G 5/36

[52] U.S. Cl. ..... 345/509; 345/508

[58] Field of Search ..... 345/27, 28, 189, 345/190, 201, 203, 508, 509; 395/164, 166, 509, 510

[56] References Cited

U.S. PATENT DOCUMENTS 4,648,707 3/1987 Pinkham et al. ..... 345/190
4,683,555 7/1987 Pinkham ..... 345/190
4,984,214 1/1991 Hiltebeitel et al. ..... 365/230.05
5,357,606 10/1994 Adams ..... 345/201

OTHER PUBLICATIONS

*IBM Technical Disclosure Bulletin*, Dual Frame Buffer Interleaving, vol. 36, No. 4, Apr. 1993, pp. 53–58.

"Mezzanine PCI," *Byte*, Jul. 1993, p. 24.

*Primary Examiner*—Jeffery Brier
*Attorney, Agent, or Firm*—George Clark; Ronald L. Drumheller

[57] ABSTRACT

An information handling system includes a central processor, a read only memory for storing microcode, a random access memory for storing instructions and data processed by the central processor, an I/O adapter for transferring data to and from peripheral devices, a user interface adapter for communicating with user devices such as a keyboard and a cursor control device, and a display adapter for converting data to be displayed to a form suitable for presentation on a display device, the display adapter including a video frame buffer architecture which allows a page mode to be used for fast screen update using commercially available chips wherein independently addressable islands on the chips are individually addressed to increase data transmission bandwidth.

6 Claims, 16 Drawing Sheets

| FIG. 4A-1 | FIG. 4A-2 | FIG. 4A-3 | FIG. 4A-4 |
|---|---|---|---|

SCREEN
1024 X 1024 PELS
= BITS / PEL

INFORMATION HANDLING SYSTEM INCLUDING MAPPING OF GRAPHICS DISPLAY DATA TO A VIDEO BUFFER FOR FAST UPDATION OF GRAPHIC PRIMITIVES

This is a continuation of application Ser. No. 08/370,090, filed Jan. 9, 1995, now abandoned.

BACKGROUND OF THE INVENTION

1. Field of the Invention

The present invention relates to information handling systems, and more particularly to information handling systems for processing graphics data for display on a display device.

2. Prior Art

There are many data processing systems in the prior art having graphics display capability. Some of the systems include graphics display subsystems such as the IBM 6095 graphics system which includes a frame buffer having two interleaved portions, wherein one portion is being loaded with new data while a second portion is being read to a display device.

An example of an attempt to improve performance of an interleaved dual frame buffer in a data processing system having a graphics display subsystem is described in an article entitled "Dual Frame Buffer Interleaving", Aranda and Henderson, *IBM Technical Disclosure Bulletin*, Vol. 36, No. 4, April 1993, pp. 53–58, inclusive.

In graphics display systems, pixels of a display are each represented by a value in a storage device referred to as a frame buffer. For a common high resolution display there are 1280 pixels in the horizontal direction by 1024 lines of pixels for a total of 1,310,720 pixels per display screen. Each pixels can be represented by from 1 to 24 bits for color or base plane data and 1 to 4 bits for overlay or attribute data. The frame buffer actually may have twice the number of bits to support the technique of interleaved buffering. Interleaved buffering is the technique of rendering to one set of locations in the buffer, for example, designated as frame buffer A while the other set of locations, designated as frame buffer B is being read to the display device.

The Aranda and Henderson article presents an architecture including a frame buffer organization which includes bandwidth for storing data to the video RAMs while supporting independent frame buffer selection on a per window basis.

A one megabit VRAM may be organized as 512 rows×512 columns×4 bits deep. Therefore, the number of VRAMs required to map a 1280×1024 screen is 5. Five VRAMs yield a single buffered 4 bit deep 1280×1024 frame buffer. To store 8 bit pixels, VRAMs are stacked 5 wide×2 deep. For a double buffer interleaved frame buffer, a second group of 5×2 VRAMs is added. If separate frame buffers are stored in separate VRAMs, the maximum number of pixels that can be stored in parallel is 5. If, however, 2 frame buffers are interleaved across both groups of VRAMs, the number of pixels that can be written simultaneously is increased to 10.

For non-windowed systems, either all of frame buffer A or frame buffer B is displayed to the display screen. The mapping of both frame buffers into VRAM is straight forward because data from both frame buffers is not required simultaneously at the output for transmission to the display device. For a typical graphics subsystem, frame buffers are mapped to VRAMs on an alternate column basis wherein each VRAM would contain half of its data assigned to frame buffer A and half of its data assigned to frame buffer B.

Although the article describes an improvement over other prior art video frame buffer architectures, the structure proposed in the article has several disadvantages. For example, the frame buffer requires five levels of logic and two separate clocks which are expensive in hardware and circuit complexity. Further, rendering of frame buffers A and B is staggered such that there is a delay between presentation of data from the two interleaved buffers.

Another prior art data processing system including efficient frame buffer architecture is described in U.S. patent application Ser. No. 08/330,294, filed Oct. 27, 1994 and now abandoned. The patent application describes a data processing system which has a frame buffer architecture for storing pixel data for display including a number of independently addressable storage units, the storage units being organized in a matrix having a number of rows and a number of columns wherein pixel data is spread across units in a row so that pixel data is distributed through a large number of independently addressable units in the frame buffer. The described system increases the effective bandwidth of the data bus carrying pixel data to the frame buffer by allowing a larger number of memory modules to be addressed concurrently.

Another frame buffer architecture includes mapping of pixels (or pels) to a VRAM to allow the buffer to be used for fast updating of blocks of 32×64 pixels. Eight VRAM chips each storing 1 megabit, with 4 bit input/output per chip is in common use in VRAMs. Many of the 1 megabit VRAM chips commercially available have four addressable islands on each chip. Thus, 8 bits of a pixel may be mapped on two such chips with one bit in each of the four islands on each chip.

For updating the screen, the buffer is accessed by applying the same address to all islands on a chip. Rows so accessed contain pixels of a 32×64 block on the screen. These bits are held in a page mode buffer and can be changed at the rate of 4 pixels (8 chips×4 bits per chip=32 bit) per page mode cycle. The page mode cycle is typically 3 to 5 times faster than the full access cycle so updating of the screen can proceed at a faster rate.

For accessing a line to refresh the screen, a diagonal section of bits must be accessed. This requires that each island on each chip be capable of accessing 32 separate rows each with a different stepped address. Thus, each island needs to be composed of 32 subislands for a total of 128 total subislands on the chip. With current VRAM chip layouts, there are far too few islands to make this mapping possible. A 1 megabit chip typically has 4 independent islands with no subislands. A 4 megabit chip typically has 16 independent islands, still far less than the required 128, and further only two such chips would be needed to produce a 1K×1K screen having 8 bits per pixel. If larger chips, with more islands having fewer bits per island, were to be available, such a mapping might be suitable. However, higher density chips typically use the previous generation chip image as an island and place multiples of such islands on the new chip to get the higher density. For example, a typical 1 megabit VRAM has 4 independent islands. The next generation of 4 megabit chips would map four of this 1 megabit macro as four islands to get the 4 times density. In order to get the kind of mapping required, it would be necessary to break the current island size into 32 smaller islands. While such a redesign is possible, it compromises the design optimization and is contrary to the evolutionary trend.

Therefore, this proposed mapping scheme is not practical with the current status and trend of chip designs.

SUMMARY OF THE INVENTION

Therefore, it is an object of the present invention to rapidly update a display using a page mode update in an information handling system having a buffer architecture which employs commercially available VRAM chips.

Accordingly, an information handling system includes a central processor, a read only memory for storing microcode, a random access memory for storing instruction and data processed by the central processor, an I/O adapter for transferring data to and from peripheral devices, a user interface adapter for communicating with user devices such as a keyboard and a cursor control device, and a display adapter for converting data to be displayed to a form suitable for presentation on a display device, the display adapter including a video frame buffer architecture which allows a page mode to be used for fast screen update using commercially available chips wherein independently addressable islands on the chips are individually addressed to increase data transmission bandwidth.

It is an advantage of the present invention that data can be transferred into the VRAM frame buffer and read out from the VRAM frame buffer in less time than prior art storage architectures.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWING

For a more complete understanding of the present invention, and the advantages thereof, reference is now made to the following descriptions taken in conjunction with the accompanying drawings, in which.

DETAILED DESCRIPTION OF A PREFERRED EMBODIMENT OF THE INVENTION

Figure 1:
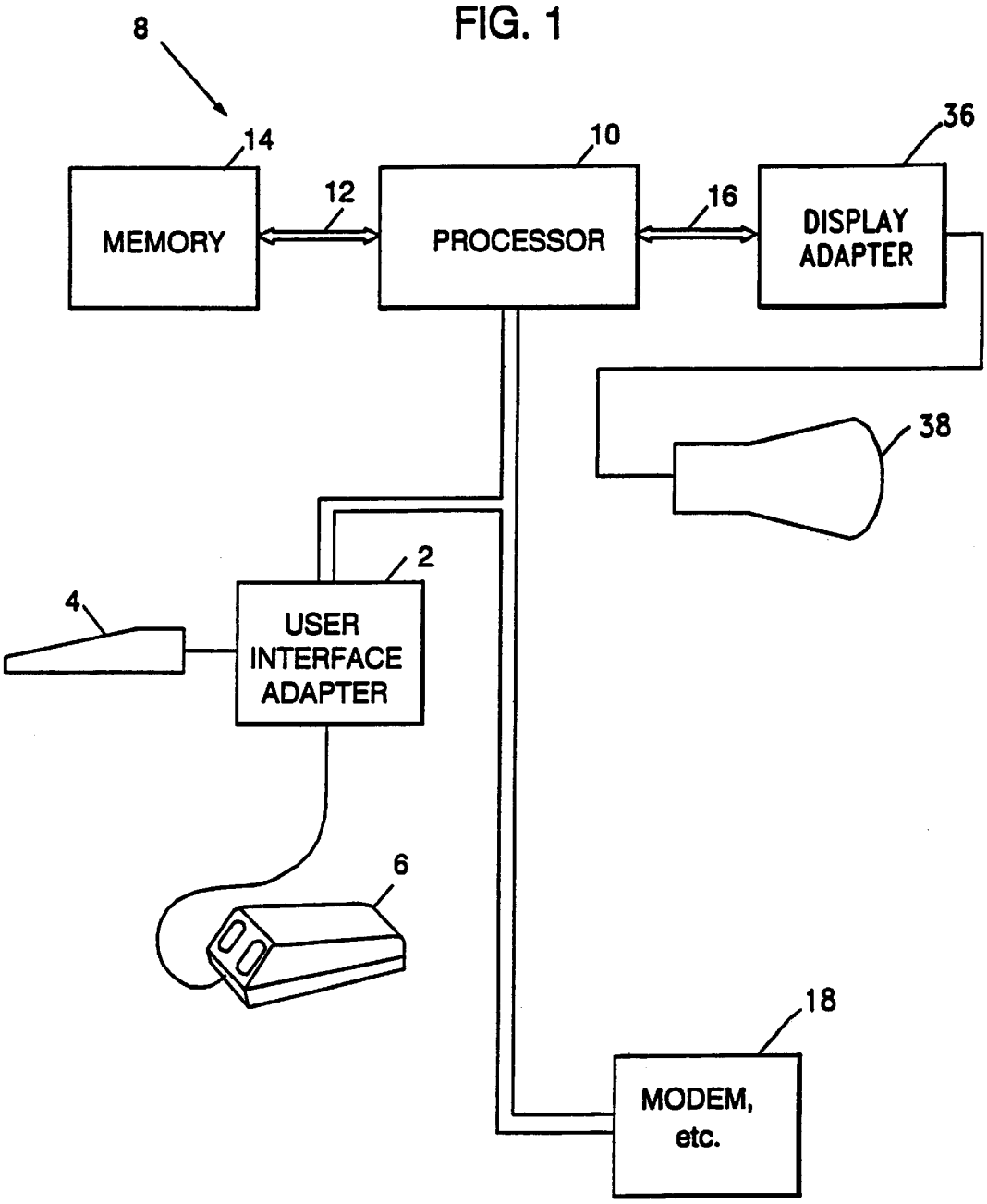
FIG. 1 is a block diagram of an information handling system for displaying graphic data implementing the present invention.

In the following description, numerous specific details are set forth such as specific word or byte lengths, etc. to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Referring now to FIG. 1, an information handling system embodying the present invention will be described.

System 8 includes a processor 10 for processing instruction and data connected to memory 14 by a memory bus 12 which allows high bandwidth data to be passed between processor 10 and memory 14. Processor 10 is also connected to a graphics adapter 18 by a high speed, high bandwidth local bus 16 for rapidly passing data to graphics adapter 18 which converts the data to a form suitable for display on display device 19. Processor 10 is also connected to an I/O bus which permits connection of a user interface adapter 22 which may provide connection to a keyboard input device 24 and a mouse cursor control device 26 and a modem or other communications device 28.

Figure 2:
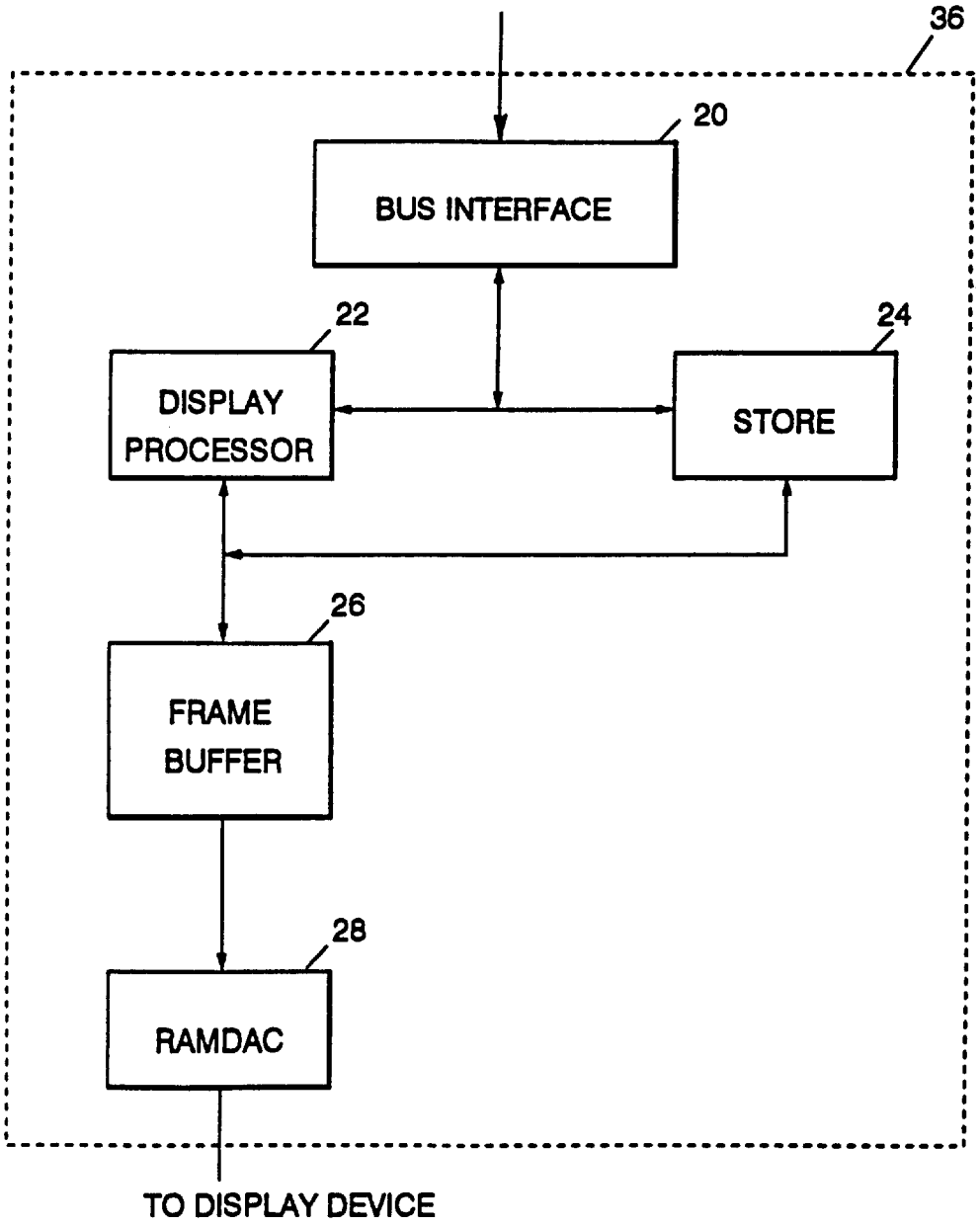
FIG. 2 is a block diagram of the display adapter of FIG. 1 in accordance with the present invention.

Referring now to FIG. 2, display adapter 36 will be described in greater detail. Bus interface 20 connects display adapter 36 to bus 12 and includes signal handshaking, send and receive buffers and other circuits commonly employed in bus interface units in display adapters. On the display adapter side of bus interface 20, bus interface 20 is connected to a display processor 22 which generates pixel data for display on display device 38 in response to commands from processor 10 and also to a local storage 24 associated with display processor 22 for storing data associated with display processor 22. Outputs of display processor 22 and local storage 24 are connected to frame buffer 26 which stores pixel data to be displayed on display device 38 in a pixel mapped matrix. Outputs of frame buffer 26 are connected to RAMDAC 28 which provides color lookup tables and digital to analog converters for providing appropriate signals for driving display device 38.

The architecture of frame buffer 26 will now be described in greater detail with reference to FIGS. 3, 4, 5 and 6.

A typical high resolution graphics display includes 1,024×1,024 pixels, each pixel having 8 bits. Thus, a frame buffer to store all pixel data for such a graphics display requires 8 megabits. A scan line is a horizontal row of 1,024 pixels to be displayed on the display device 38 and which is refreshed line by line typically at a rate of 60 times per second.

Display 302 is made up of a number of blocks 304 of pixels. Each block 304 includes in the embodiment shown in FIG. 3 32 horizontal line segments 306, each line segment 306 including 64 pixels, thus, a block 304 includes 32 lines of 64 pixels or 2K pixels per block. Thus, for a display screen having 1 meg pixels, there would be a total of 512 blocks to represent the entire screen 302. As indicated above, each pixel is typically represented by 8 bits.

It should be also noted, that although in the preferred embodiment of the present invention, the block size is indicated as 64 bits along the horizontal line×32 rows per block, other block sizes are possible, such as 32 pixels in the horizontal direction×64 rows each, or 32 pixels along the horizontal row×32 rows, etc. Each line segment 306 in each block 304 may be referred to as a pixel group labeled $P_{1,1}$; $P_{2,1}$; $P_{3,1}$ . . . $P_{32,1}$, etc. The first subscript indicates the screen row or scan line number of the pixel group and the second subscript indicates the horizontal position of the pixel group on the screen from 1 (left side of the screen) to 16 (right side of the screen). Thus, $P_{1,1}$ specifies a pixel group 306 on the 1st row of the first of 16 horizontal pixel group positions, or the first row of the first pixel block 304.

As another example, $P_{32,1}$ specifies a pixel group on the 32nd row of the first of 16 horizontal pixel group positions, or the last row of the first block 304.

Figure 3B:
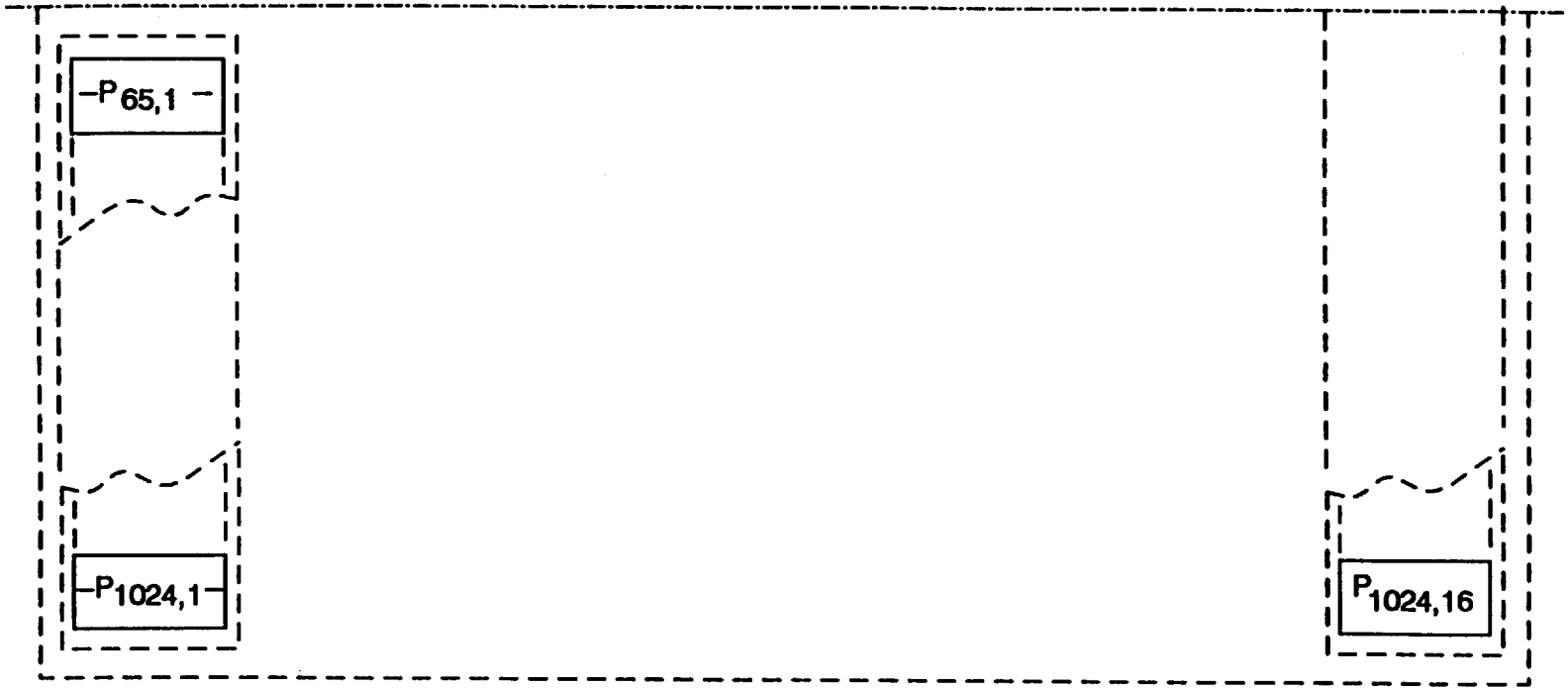
FIG. 3 is a schematic representation of a display screen having 1,024 pixels on each horizontal line and 1,024 lines of pixels showing the mapping of pixel data into blocks of predetermined size.
Figure 3:
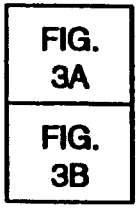
Figure 3A:
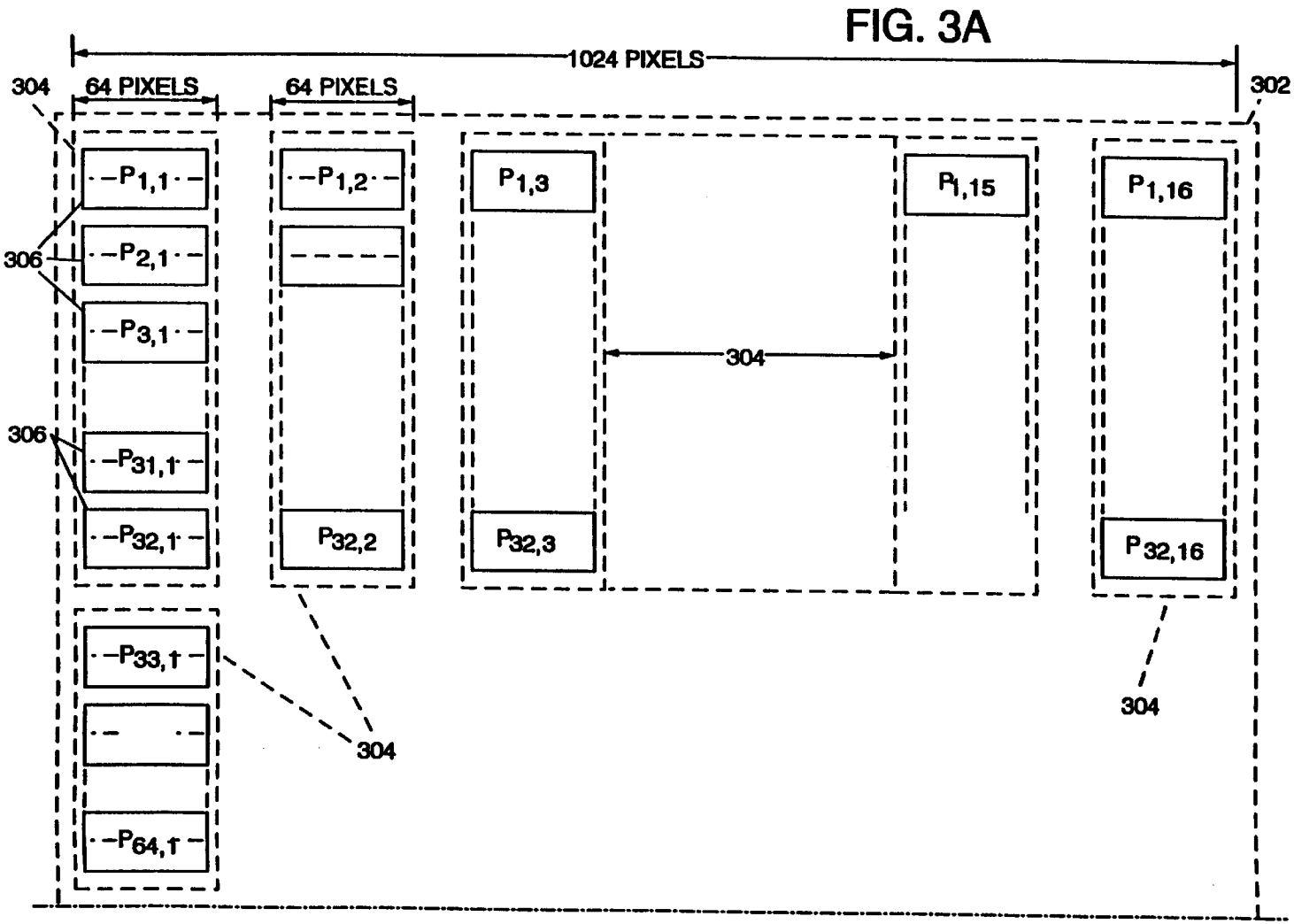
Figures 1, 4A:
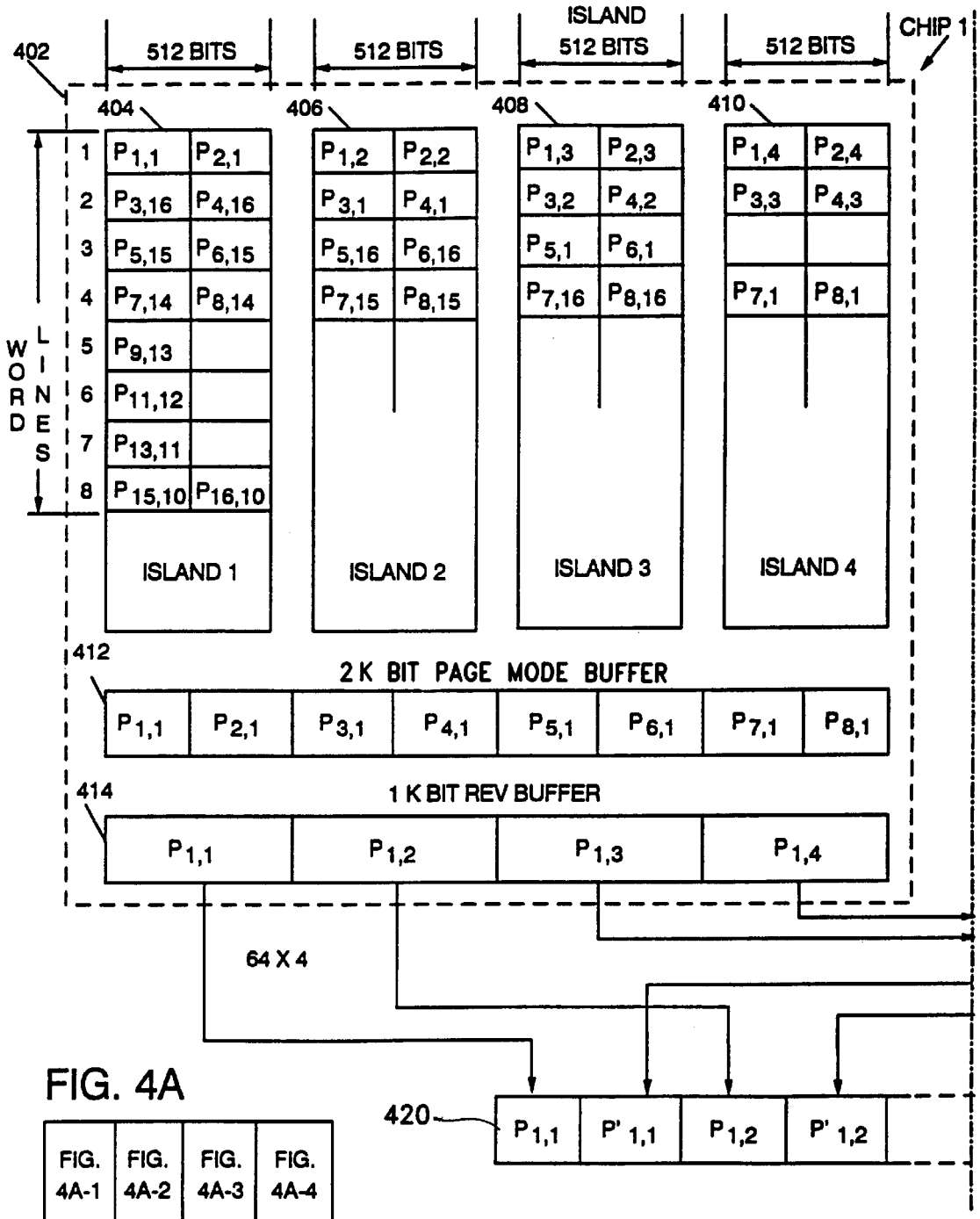
Figures 2, 4A:
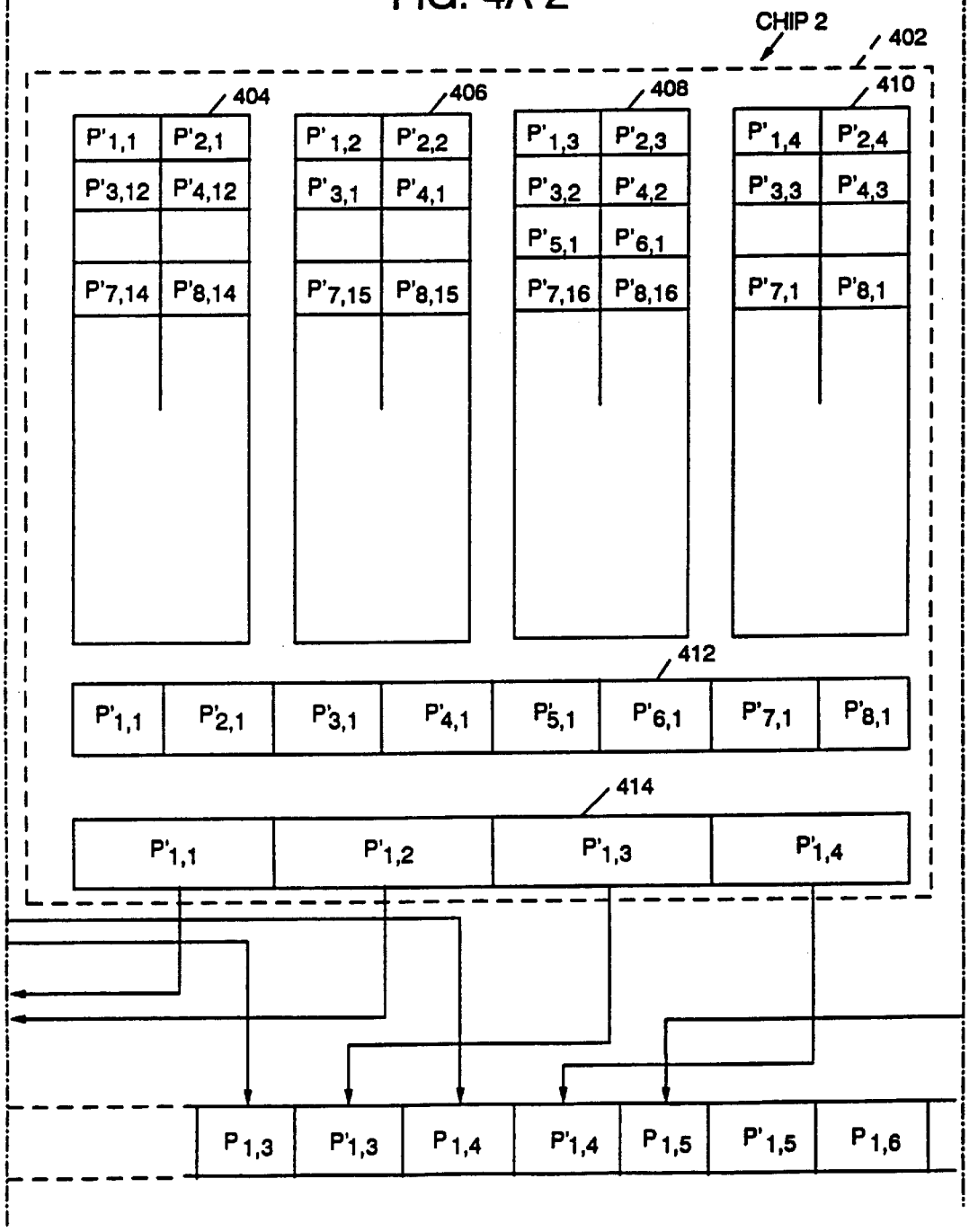
Figures 3, 4A:
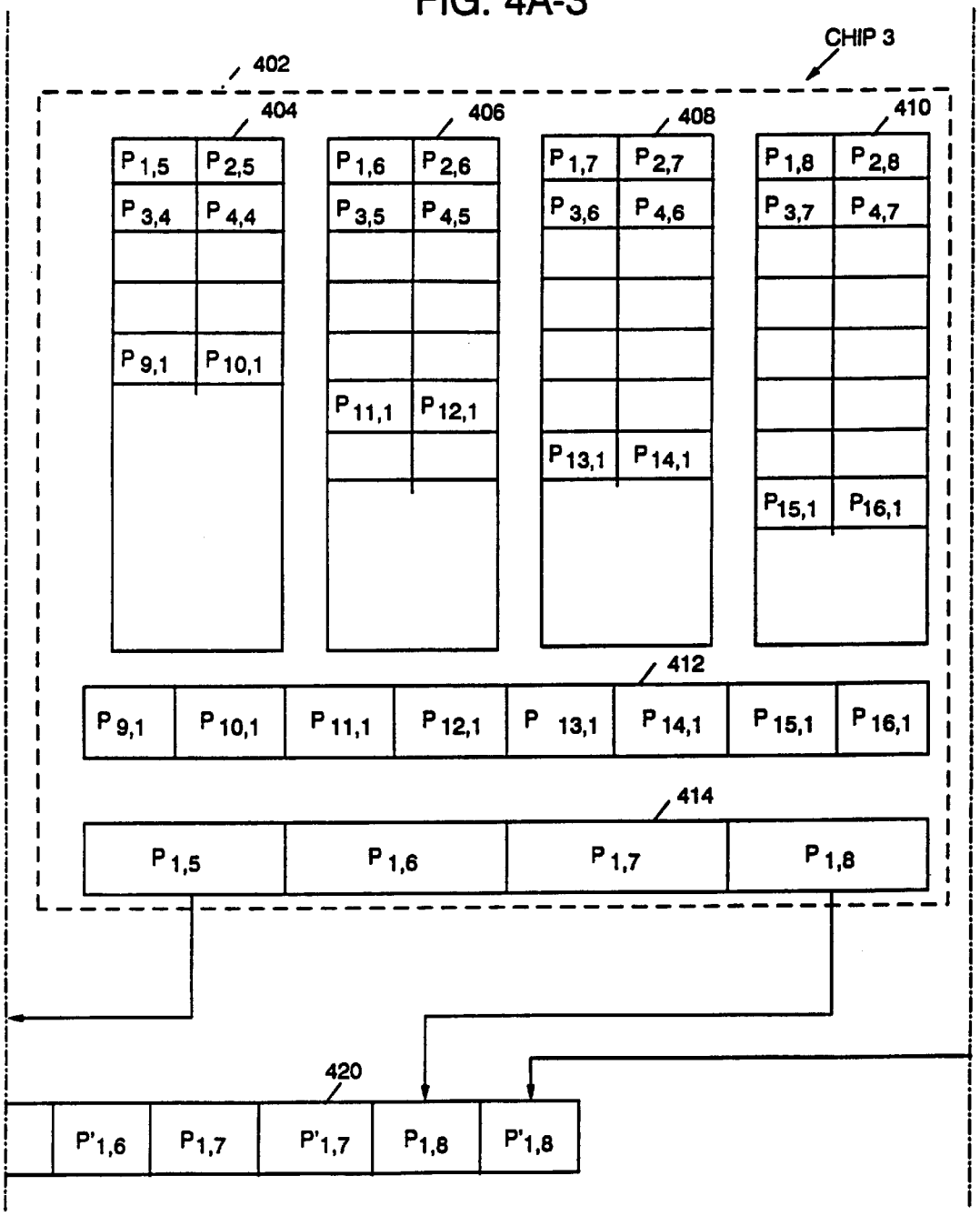
Figures 4, 4A:
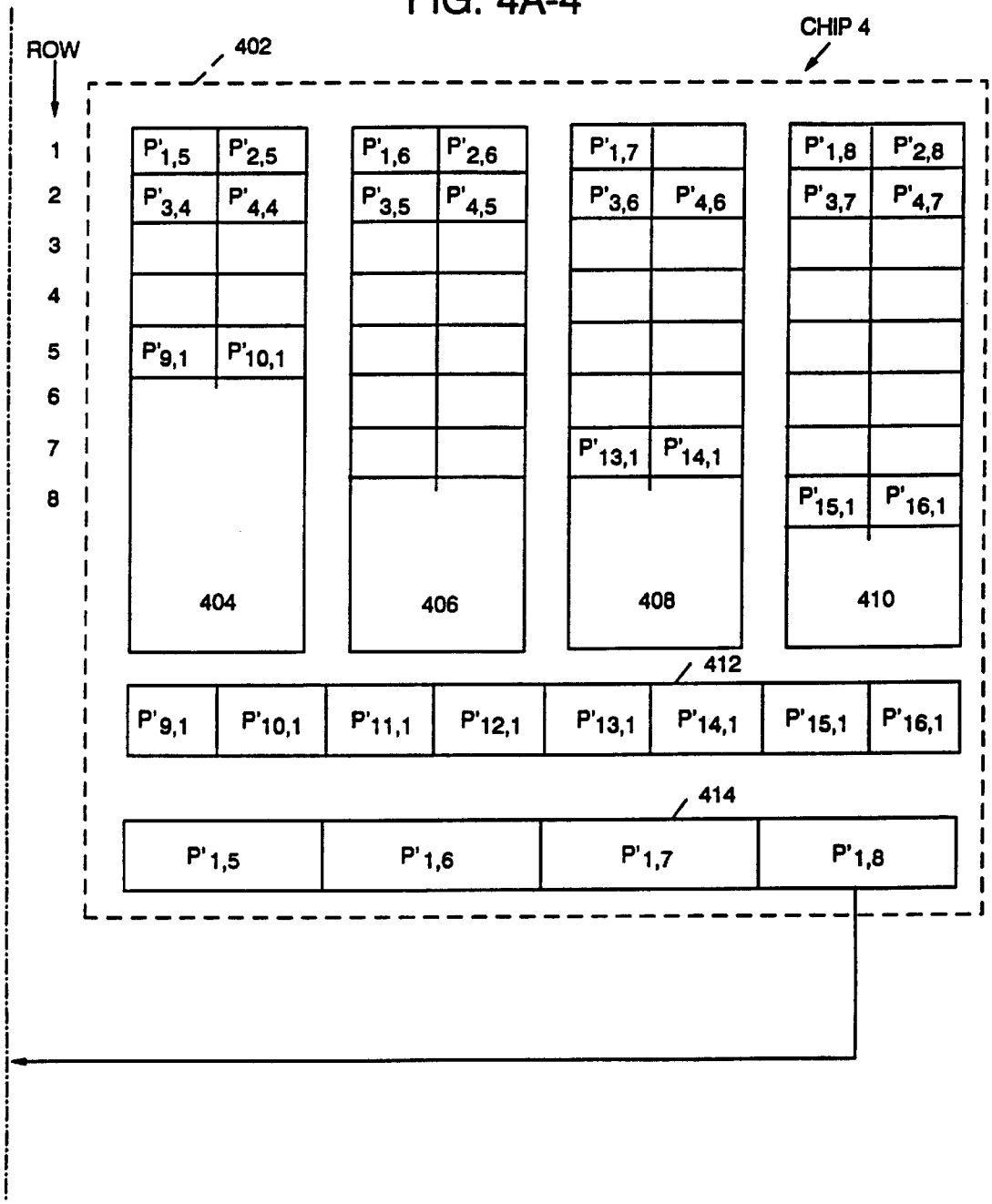
FIG. 4, consisting of FIGS. 4A-1, 4A-2, 4A-3, 4A-4, 4B-1, 4B-2, 4B-3, and 4B-4, is a schematic representation of mapping of display screen pixels of FIG. 3 for page mode updating of blocks of predetermined size.
Figures 1, 4B:
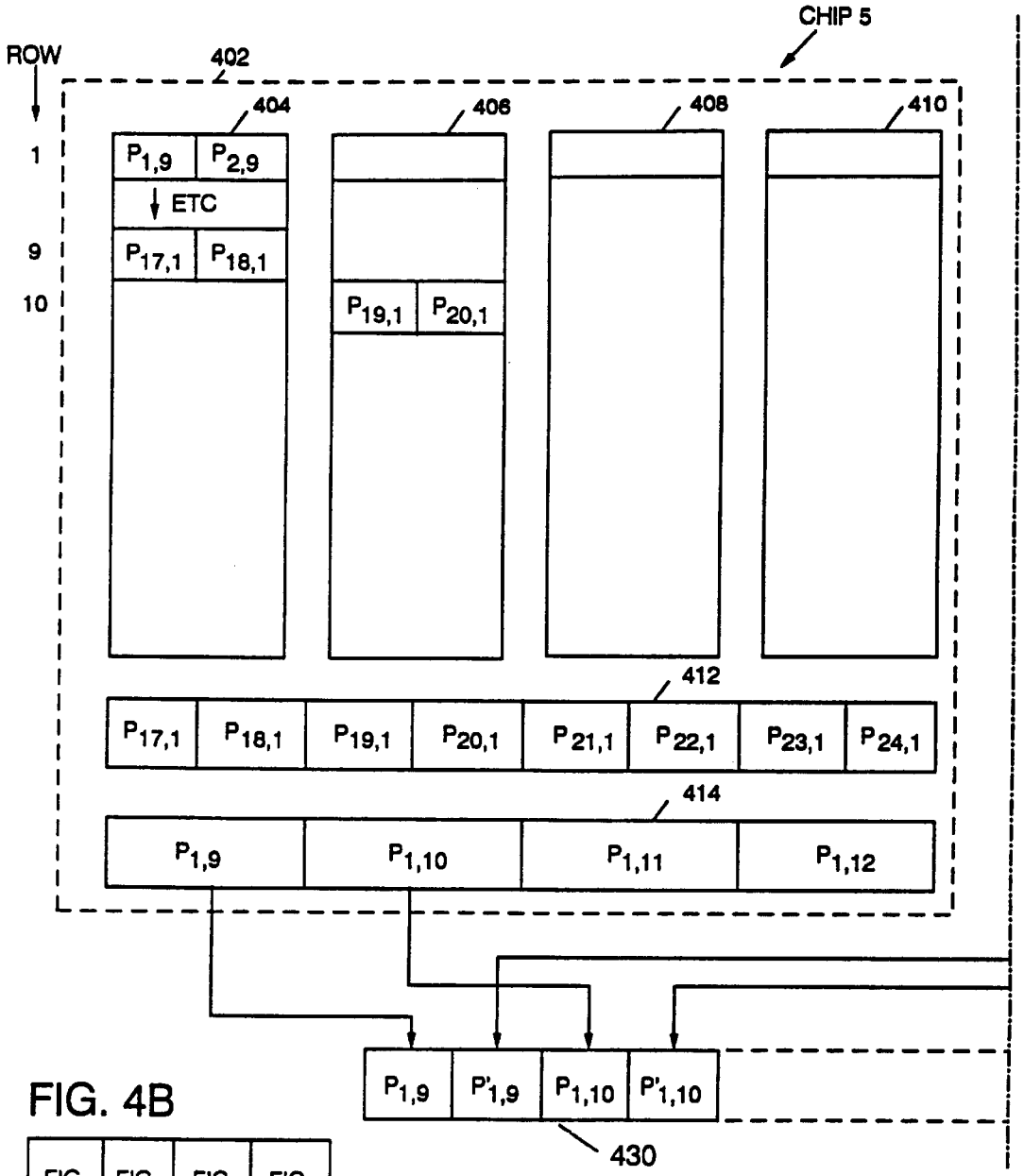
Figure 4B:
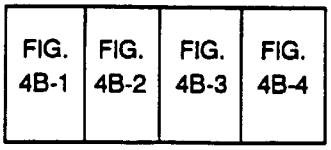
Figures 2, 4B:
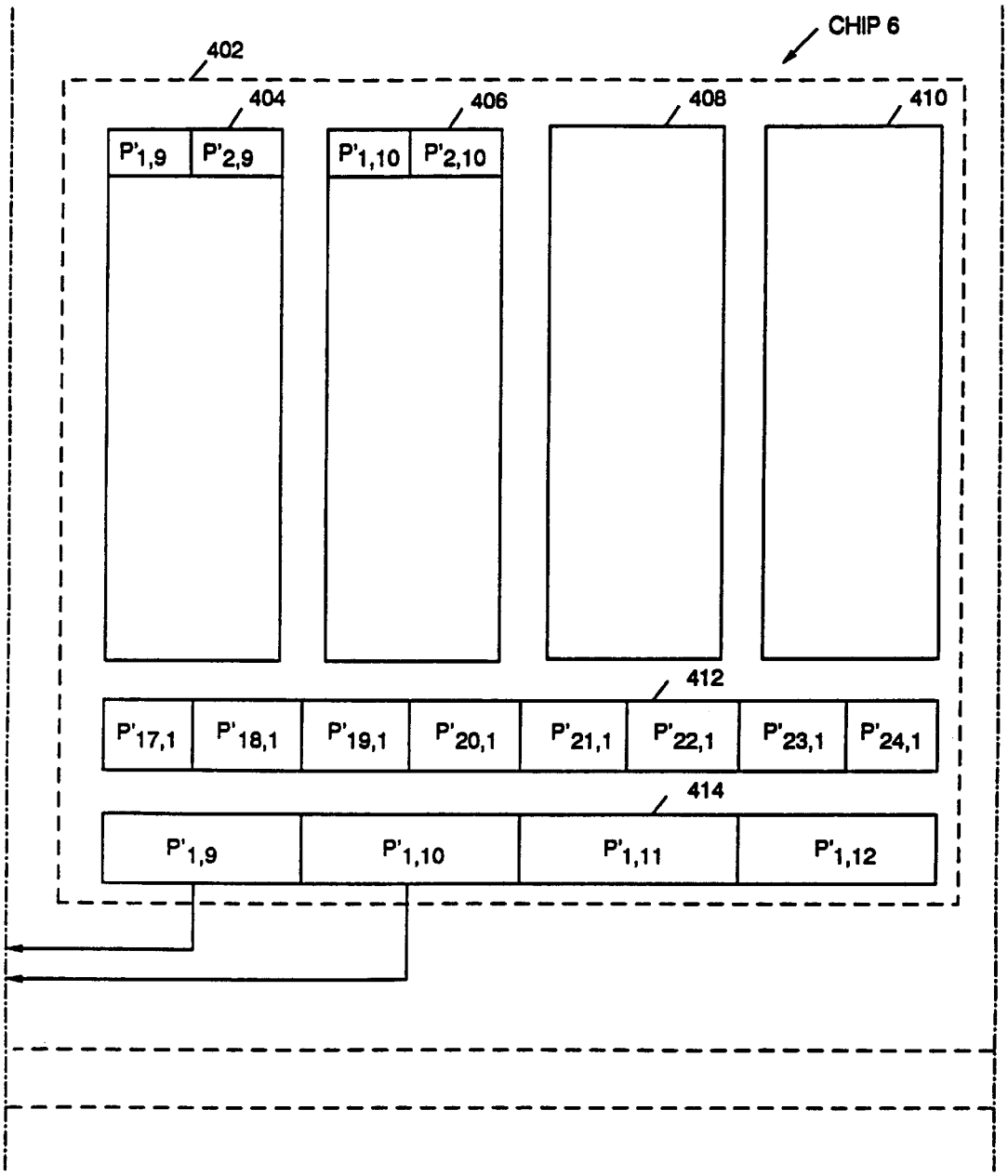
Figures 3, 4B:
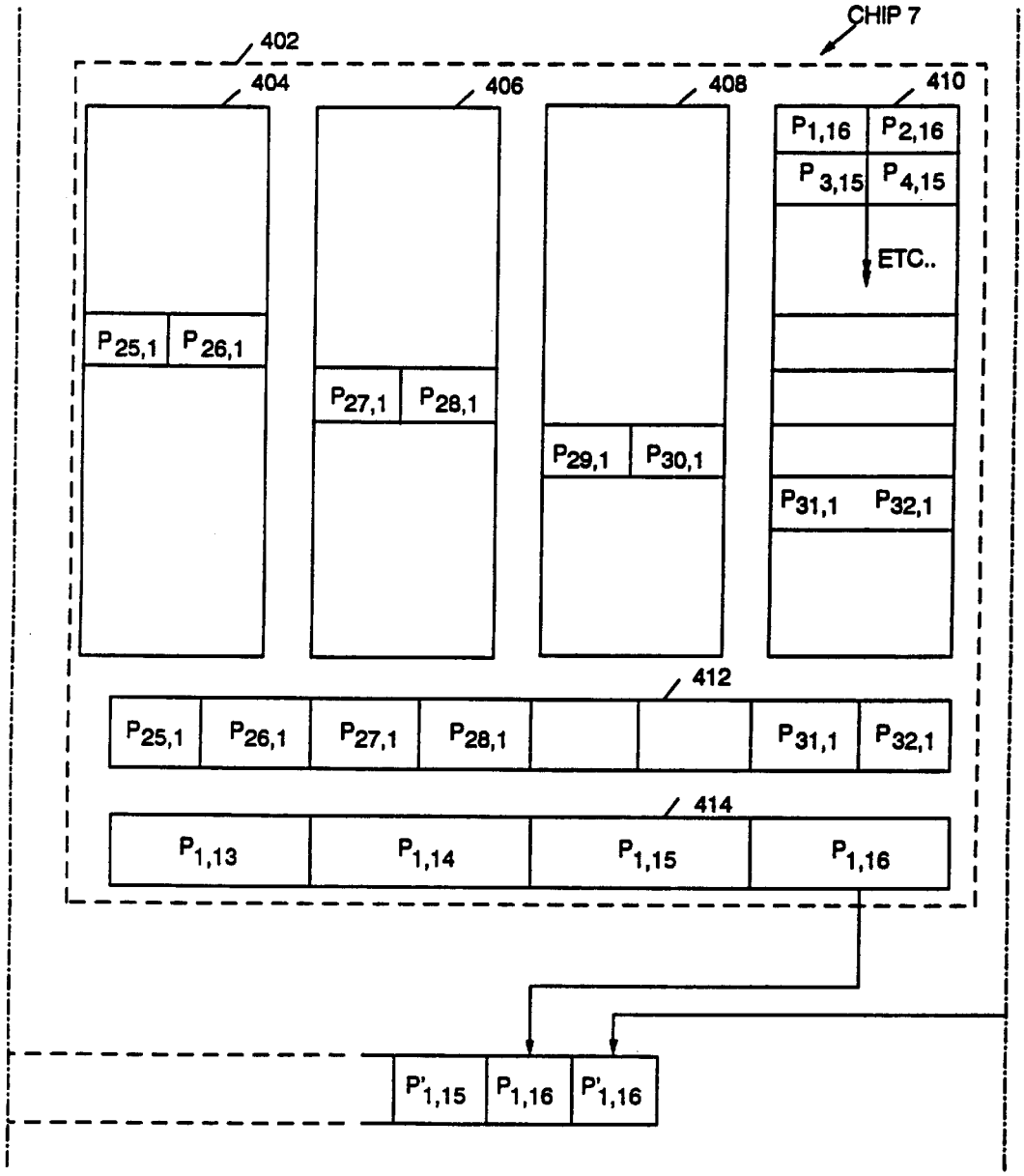
Figures 4, 4B:
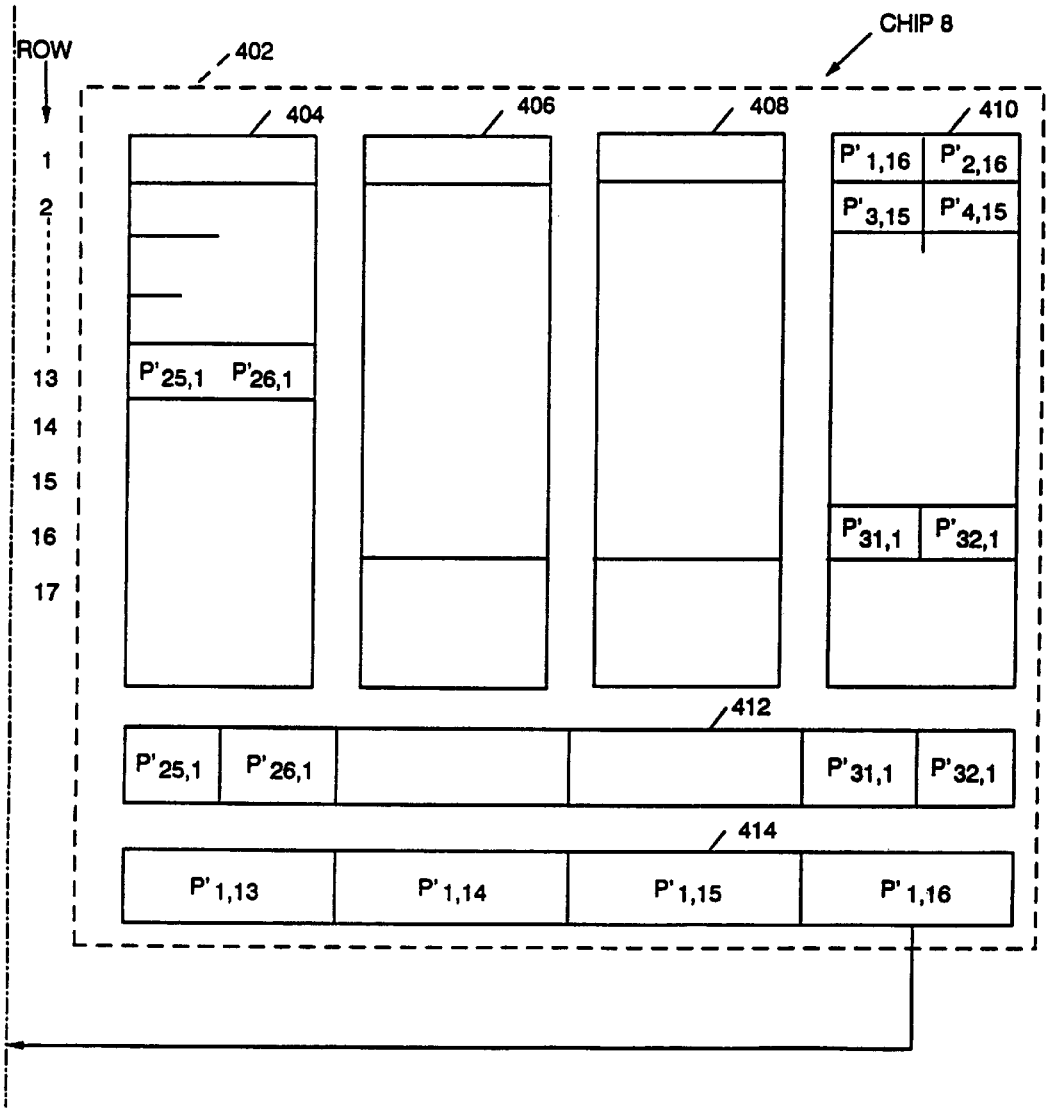

Referring now more specifically to FIG. 4, the mapping of the pixels shown in FIG. 3 onto a group of VRAM chips 402 will be described. The 1 mega pixel display screen of FIG. 3 is mapped into 8 VRAM chips 402 each having a storage capability of 1 megabit. Each VRAM chip 402 has independently addressable islands 404, 406, 408 and 410. Each chip also has the capability of transferring data 4 bits at a time to or from chips 402. Each island, such as 404, includes 512 rows×512 bits per island. A row on each island 404, etc. is logically divided into two groups of 64×4 bits per group, with two such groups for each row. Stated differently, each row on an island 404 contains two groups of 64 half pixels. A pixel has 4 bits stored on the same row on two islands 404 with the islands being on adjacent chips such as chip 1 402 and chip 2 402. As an example, pixel group $P_{1,1}$ on the screen is mapped to chips 402 as two pixel groups $P_{1,1}$ on chip 1 402 and $P'_{1,1}$ on chip 2 402. Other pixel groups are similarly mapped to chips 402. Each chip 402 includes a page mode buffer register 412. Any block of pixels 304 can be accessed and held in the page mode buffer 412 for subsequent writing at a page mode rate which is faster than a normal random access rate. For example, to write to the first block 304 which starts with pixel group $P_{1,1}$, the rows of each island 404, 406, 408 and 410 are accessed as follows:

| | |
|---|---|
| Chip 1 | |
| Island 1 | Row 1 |
| Island 2 | Row 2 |
| Island 3 | Row 3 |
| Island 4 | Row 4 |
| Chip 2 | |
| Island 1 | Row 1 |
| Island 2 | Row 2 |
| Island 3 | Row 3 |
| Island 4 | Row 4 |
| Chip 3 | |
| Island 1 | Row 5 |
| Island 2 | Row 6 |
| Island 3 | Row 7 |
| Island 4 | Row 8 |
| Chip 4 | |
| Island 1 | Row 5 |
| Island 2 | Row 6 |
| Island 3 | Row 7 |
| Island 4 | Row 8 |
| Chip 5 | |
| Island 1 | Row 9 |
| Island 2 | Row 10 |
| Island 3 | Row 11 |
| Island 4 | Row 12 |
| Chip 6 | |
| Island 1 | Row 9 |
| Island 2 | Row 10 |
| Island 3 | Row 11 |
| Island 4 | Row 12 |

-continued

| | |
|---|---|
| Chip 7 | |
| Island 1 | Row 13 |
| Island 2 | Row 14 |
| Island 3 | Row 15 |
| Island 4 | Row 16 |
| Chip 8 | |
| Island 1 | Row 13 |
| Island 2 | Row 14 |
| Island 3 | Row 15 |
| Island 4 | Row 16 |

A complete block 304 of 64×32 pixels at 8 bits per pixel is stored in the 2K bit page mode buffers 412 on each chip for a total of 16K bits stored in the page mode buffers of the 8 chips which form frame buffer 28. If the first 4 bits of $P_{1,1}$ is written into page mode buffer 412 on chip 1 and similarly the first 4 bits of $P'_{1,1}$ from chip 2 is written into page mode buffer 412 on chip 2, the 8 bits required to identify the attribute of a first pixel on the display screen are available. By selecting two paired chips, any pixel can be updated in each block 304 at 1 bit per page mode cycle. When the last 4 bits of $P'_{32,1}$ and $P'_{32,1}$ are written into respective page mode buffers 412 of chips 7 and 8, respectively, the last pixel of the first block 304 on scan line 32 is written. It is clear from FIG. 4 and the above description that the location thus the addressing of bits within a block 304 depends upon which scan line is being examined or changed. When the first pixel of scan line 1 starts on a first island 404 of chip 1 402, the first pixel of scan line 12 starts on the second island 406 of chip 3 402. The addressing logic is implemented to properly address individual islands 404, etc. on each chip 402 in the proper order to access data for presentation to display device 38 in the proper order. Since each chip 402 has the capability of providing 4 bits per cycle, four pixels in each block 404 can be accessed on one page mode cycle as long as the four pixels reside on different chip pairs. This requires different 10 bits addresses to select 4 bits of 4,096 bits to each chip pair and are supplied on the chip address line. The random access cycle can also be used to write pixels to the display, however, the random access cycle is slower than the page modes cycle, it would be faster if each sequential write was to a different block 402 on the screen. In addition to page mode buffers 412, each chip 402 has a row buffer 414 to hold the scan line data for refreshing the display screen. If scan line 1 is to be refreshed, then row 1 of each island 404, 406, 408, 410 is accessed. This will provide data for scan lines 1 and 2. If row buffer 414 on each chip stores 2K bits, then the data for scan lines 1 and 2 can be stored and 2 scan lines can be refreshed with one access to the array 302.

However, a more cost effective implementation would be to have each row buffer 414 capable of storing 1K bit. After accessing the row of each island 404, etc., 256 out of 512 bits are selected for each island 404, etc. Scan line 1 is shown stored in row buffer 414.

Since each chip 402 supplies 4 bits of an 8 bit pixel, 4 bits from alternate chips must be interleaved to complete the 8 bits necessary for a full description of each pixel. This interleaving is accomplished with off chip register 420.

Figure 5:
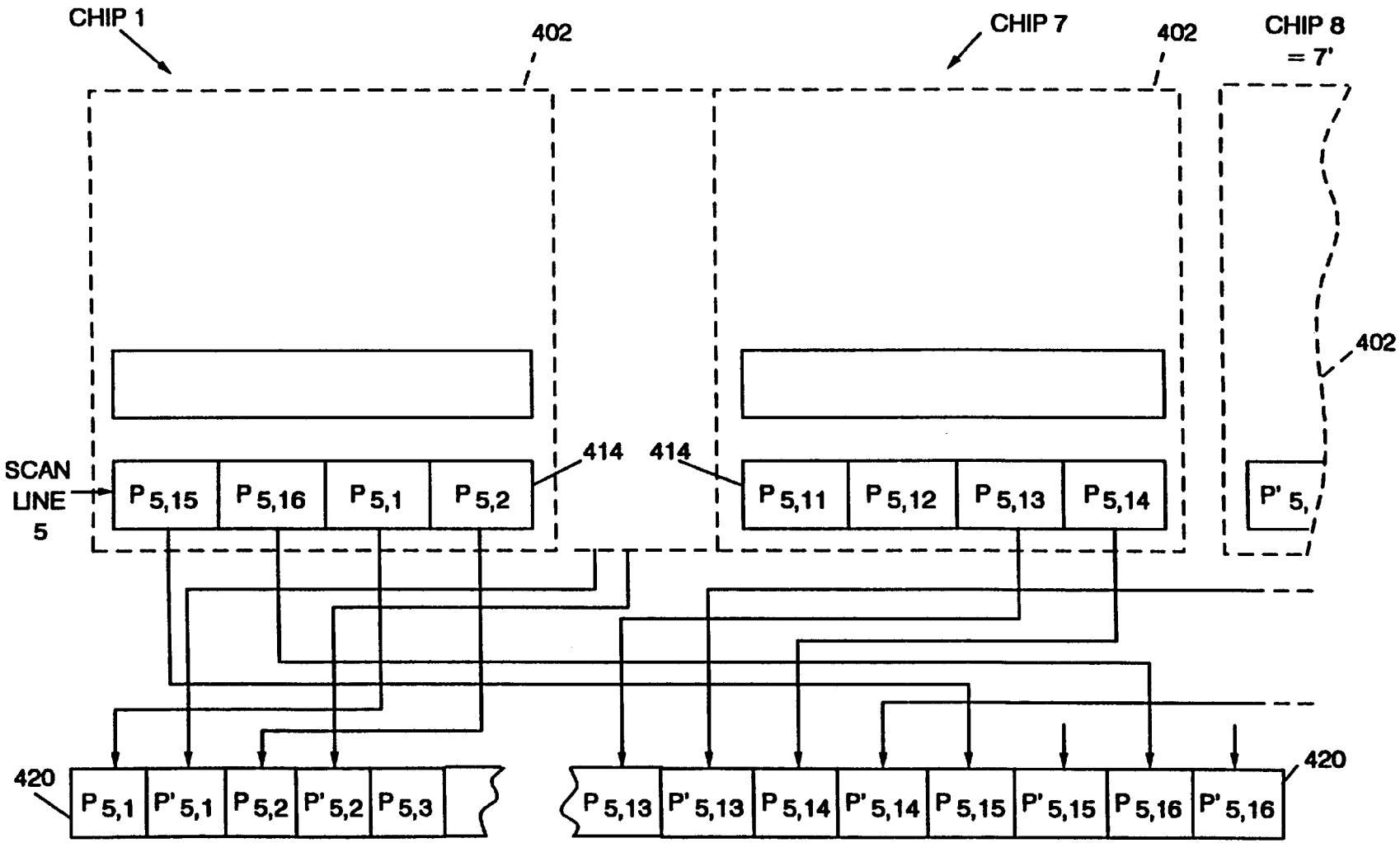
FIG. 5 is a schematic diagram showing pixel interleaving between different chips of the VRAM buffer in accordance with the present invention.

An example of shifting and interleaving for scan line 5 into off chip register 420 is shown in FIG. 5.

With the pixel mapping shown with respect to FIG. 4, a scan line is accessed by applying the same address to all islands 404, 406, 408 and 410 on all chips 402 while a block 304 for writing is accessed by using stepped addressing or different row addresses to islands 404, etc. on chip pairs such as 402 chip 1 and 402 chip 2.

Figure 6A:
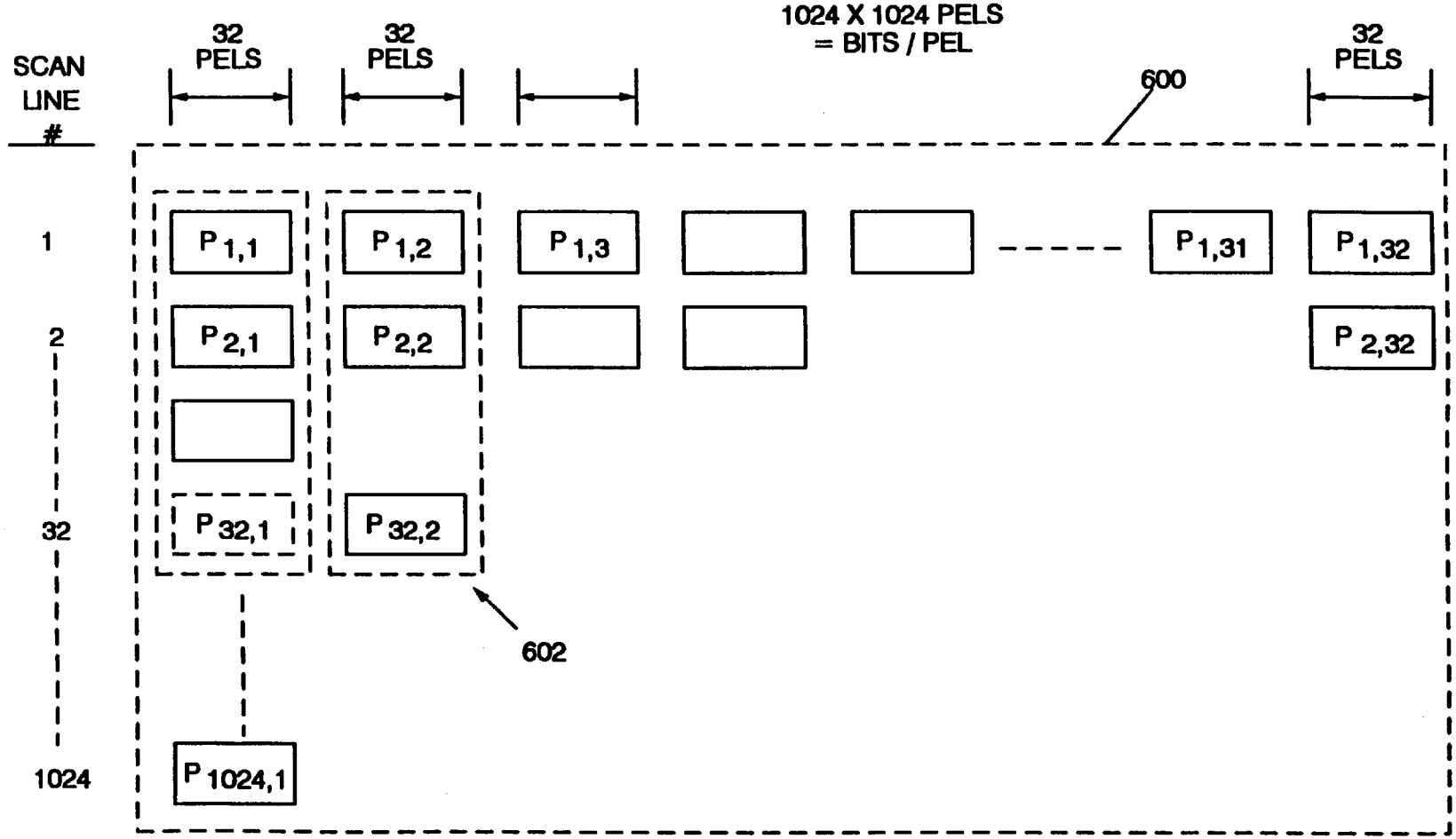
FIG. 6 is a schematic diagram of an alternative mapping of pixels to a display screen employing a different size predetermined block for page mode pixel update in accordance with the present invention.
Figure 6B:
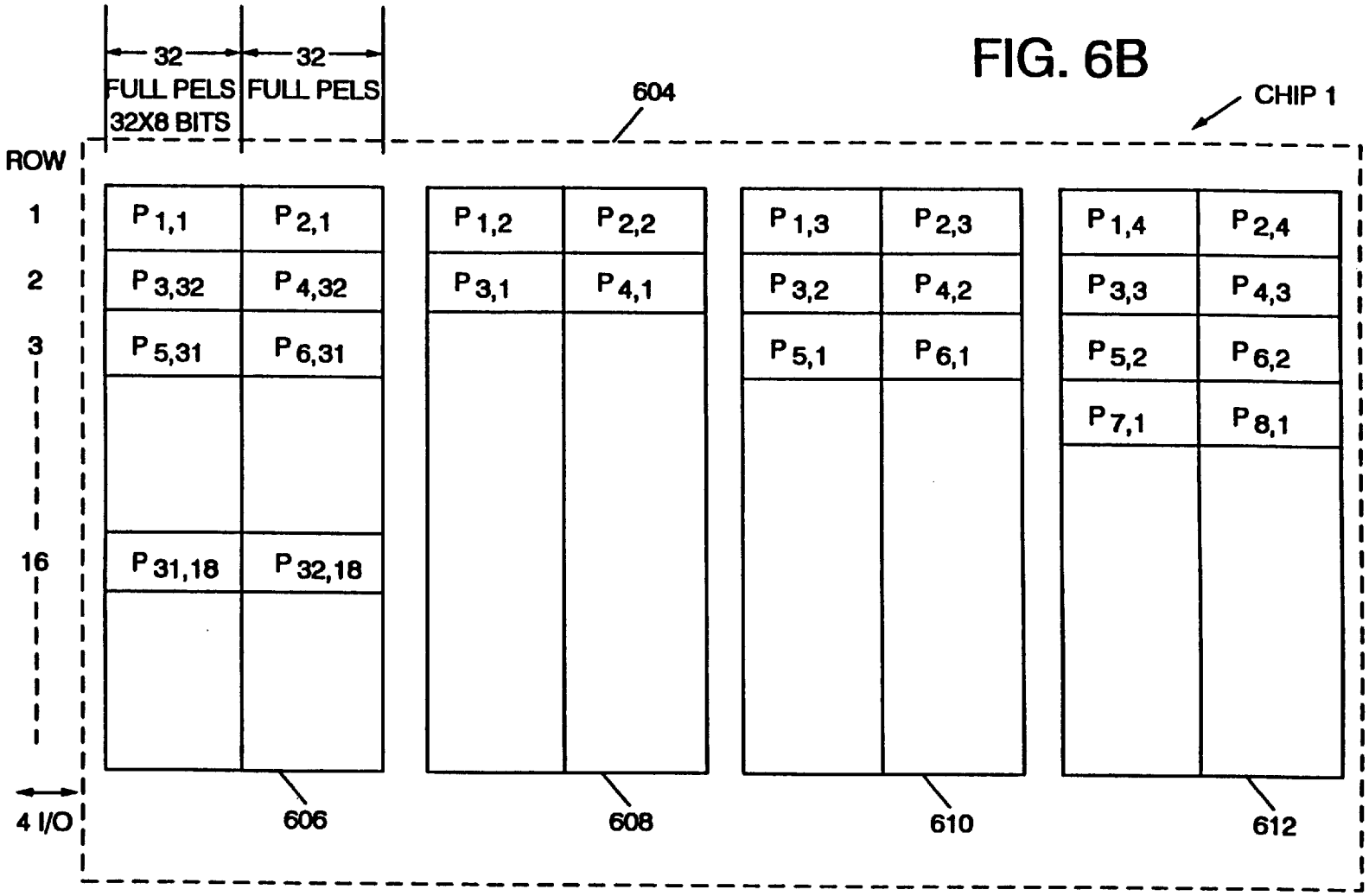
Figure 6C:
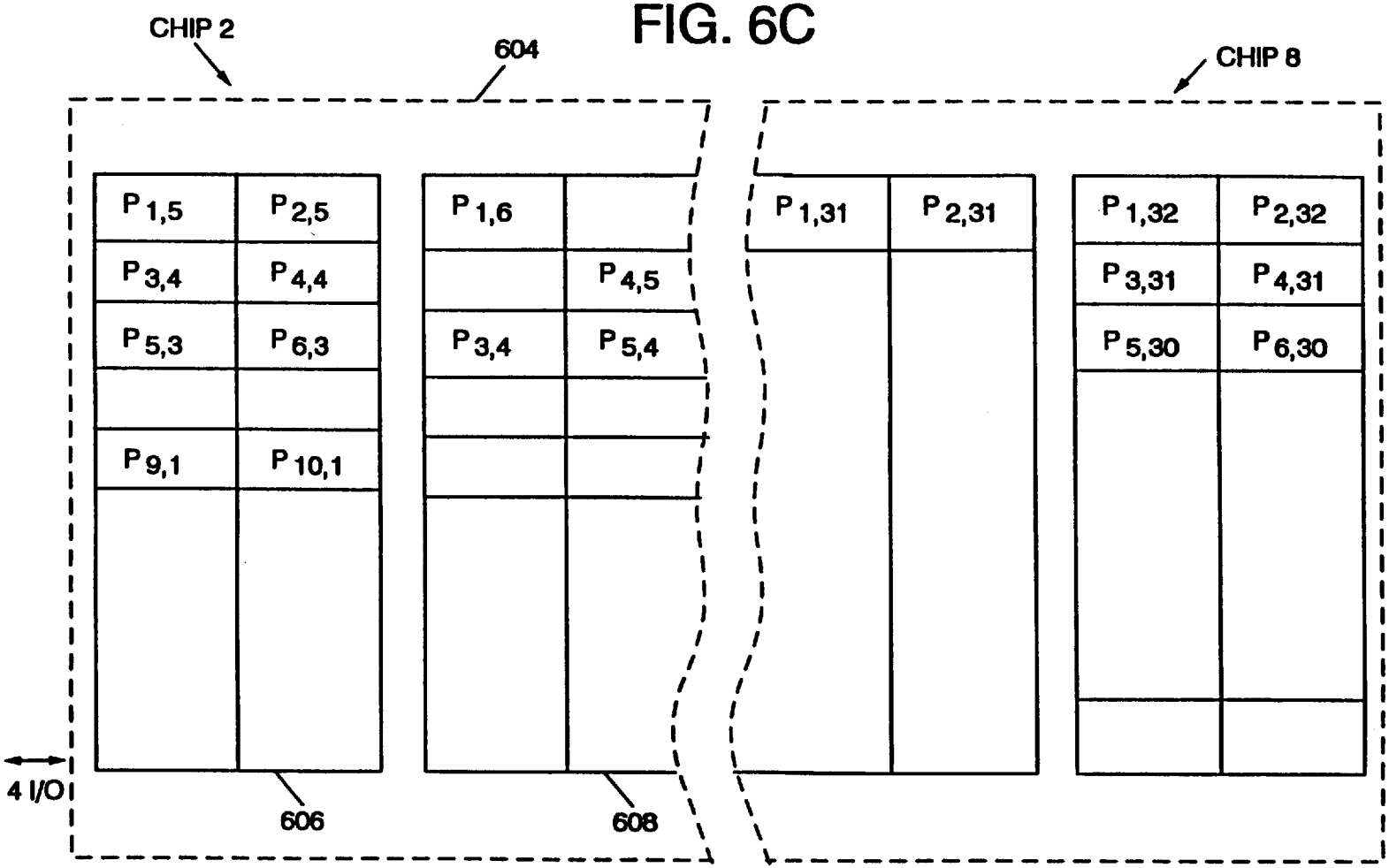

Referring to FIG. 6, an alternative embodiment in which pixel blocks 602 are each 32×32 pixels. In the embodiment shown in FIG. 6, all bits of each pixel can be shown on a single chip 604 rather than two chips 402 as described above with respect to a preferred embodiment of the present invention. All 8 bits of any pixel are stored on the same row of island 606, 608, 610, 612 of each chip 604. Thus, a row in each island such as 606 contains two groups each containing 32 pixels fully described by 8 bits, or 64 fully described 8 bit pixels per island row. The mapping is very similar to that described above with respect to the preferred embodiment of the present invention except that there are now 32 pixel groups in the horizontal direction for each line rather than 16 as described above with respect to the preferred embodiment of the present invention. Blocks and scan lines are still stored across all 8 chips 604 in video storage 600.

The advantage of the alternative embodiment describe above with respect to FIG. 6 is that since all bits of each pixel are stored together on a single chip, no off chip interleave buffer such as buffer 420 is required in this alternative embodiment.

Although the present invention and its advantages have been described in detail, it should be understood that various changes, substitutions and alterations can be made herein without departing from the spirit and scope of the invention as defined by the appended claims.

What is claimed is:

1. A frame buffer comprising a set of independently accessible information storage units for storing pixel information for a device having pixels arranged into a matrix of columns and rows, said rows and columns of pixels also being subdivided for purpose of storage of pixel information in said frame buffer into a plurality of sets of contiguous rows and a plurality of sets of contiguous columns forming pixel blocks and pixel groups, a pixel group being the pixels in a row that are within a set of columns and a pixel block being the pixel groups in a set of rows that are within a set of columns, the pixel information of the pixel groups in a same row being distributed among said independently accessible information storage units at a same address within each of said storage units and the pixel information of the pixel groups in a same pixel block also being distributed among said independently accessible information storage units, whereby the pixel information for a complete row is inputted in parallel into said frame buffer in a page mode of transfer and the pixel information for a complete pixel block also is accessible in a block mode of transfer.

2. A frame buffer as in claim 1 wherein the pixel information of successive pixel groups in each row are stored in different ones of said independently accessible information storage units.

3. A frame buffer as in claim 1 wherein pixel information for each pixel is divided into two portions and each portion is stored in a separate one of said independently accessible information storage units.

4. A frame buffer as in claim 1 wherein a single chip comprises a group of said independently accessible information storage unit.

5. A frame buffer as in claim 1 wherein the pixel information of successive pairs of rows of pixel groups within each pixel block is stored in said frame buffer beginning at different ones of said independently accessible information storage units.

6. A frame buffer for storing discreet representations of information for display on a display device having pixels arranged into a matrix of columns and rows, said rows and columns of pixels also being subdivided for purposes of storage of pixel information in said frame buffer into a plurality of sets of contiguous rows and a plurality of sets of contiguous columns forming pixel blocks and pixel groups, a pixel group being the pixels in a row that are within a set of columns and a pixel block being the pixel groups in a set of rows that are within a set of columns, said frame buffer comprising a matrix of discreet storage devices for storing said discreet representations of information to be displayed, each said discreet storage device having a plurality of independently accessible storage units for storing discreet representations of information for said display device, the discreet representations of information for the pixel groups in a same row being distributed among said independently accessible storage units at a same address within each of said storage units and the discreet representations of information for the pixel groups in a same pixel block also being distributed among said independently accessible storage units, whereby the discreet representations of information for a complete row is inputted in parallel into said frame buffer in a page mode of transfer and the discreet representations of information for a complete pixel block also is accessible in a block mode of transfer.

* * * * *